United States Patent [19]

Manservisi

[11] 4,238,025

[45] Dec. 9, 1980

[54] DEVICE FOR REPLACING DEFECTIVE ARTICLES

[75] Inventor: Renato Manservisi, Bologna, Italy

[73] Assignee: Cir S.p.A. Divisione Sasib, Bologna, Italy

[21] Appl. No.: 28,672

[22] Filed: Apr. 10, 1979

[30] Foreign Application Priority Data

Apr. 18, 1978 [IT] Italy ..... 12569 A/78

[51] Int. Cl.[3] ..... B65G 47/68

[52] U.S. Cl. ..... 198/450; 198/565; 198/370; 221/95; 221/116

[58] Field of Search ..... 198/347, 356–358, 198/370, 448–452, 565; 209/552, 644; 221/95, 116, 133

[56] References Cited

U.S. PATENT DOCUMENTS

| | | | |
|---|---|---|---|
| 1,694,599 | 12/1928 | Lea | 221/116 |
| 2,141,460 | 12/1938 | Brown et al. | 198/450 |
| 3,040,862 | 6/1962 | Schmermund et al. | 209/552 |
| 3,344,954 | 10/1967 | Peppler et al. | 198/347 |
| 3,871,511 | 3/1975 | Wentz et al. | 198/358 |

*Primary Examiner*—Joseph E. Valenza

*Attorney, Agent, or Firm*—Spencer & Kaye

[57] ABSTRACT

The device for automatically replacing defective cigarette packets discarded from a feeding line on which the packets advance in a single row comprises a pair of gravity-feed reserve hoppers, containing each a stack of reserve packets, and a transferring drum, operatively interposed between the said reserve hoppers and the feeding line. The drum is driven in step-by-step rotation in relation to the absence, signalled by suitable sensing and controlling devices, of a discarded defective packet. Upon each step rotation of the transferring drum, a cigarette packet is taken by the drum alternately from one of the said reserve hoppers, and it is progressively transferred onto the feeding line, to take the place of the previously discarded packet.

6 Claims, 4 Drawing Figures

1
2
3
4
6
7
8
8'
11
12
13
14
14
15
16
16
P
P
P
P

DEVICE FOR REPLACING DEFECTIVE ARTICLES

STATEMENT OF PRIOR ART

In accordance with 37 CFR 1.56 and 37 CFR 1.97, applicant cites the following prior art:

(1) U.S. Pat. No. 4,004,677 (HEIER)—FIG. 2A.

(2) U.S. Pat. No. 3,405,579 (LONDON)—FIGS. 1, 2 and 3.

The above prior art is cited just as being of interest, as teaching the concept of combining a multiplicity of source lines into a single feed line.

SUMMARY OF THE INVENTION

The present invention relates to a feeding device associated to a packaging or parcelling machine, i.e. to a machine which forms packages out of groups of articles which are fed to the said packaging machine in a single row. More particularly, the present invention relates to a device for automatically replacing defective articles, such as cigarette packets, discarded from a feeding line on which the packets advance in a single row.

The device according to the present invention is particularly suitable for being fitted between a cellophane wrapping machine, which wraps the cigarette packets in a cellophane wrapper, and a packaging or parcelling machine, which forms packages of a predetermined group of cigarette packets.

According to the invention, a device for automatically replacing defective cigarette packets, discarded from a feeding line, on which the packets advance in a single row, comprises a pair of gravity-feed reserve hoppers, containing each a stack of reserve packets, and a transferring drum, operatively interposed between the said pair of hoppers and the feeding line, said drum being driven in step-by-step rotation in relation to the absence on the said feeding line, signalled by suitable sensing and controlling devices, of a discarded defective packet. The axis of rotation of said transferring drum is arranged transversely with respect to the direction of advancement of the said feeding line. Upon each step rotation of the transferring drum, a packet is taken alternately from one of the said reserve hoppers, and it is progressively transferred to the said feeding line, to take the place of the previously discarded packet.

The above and other features of the invention, and the advantages deriving therefrom, will appear evident from the following detailed description of a preferred embodiment, made by way of non-limiting example with reference to the attached drawings.

DESCRIPTION OF THE PREFERRED EMBODIMENT

Figure 2:
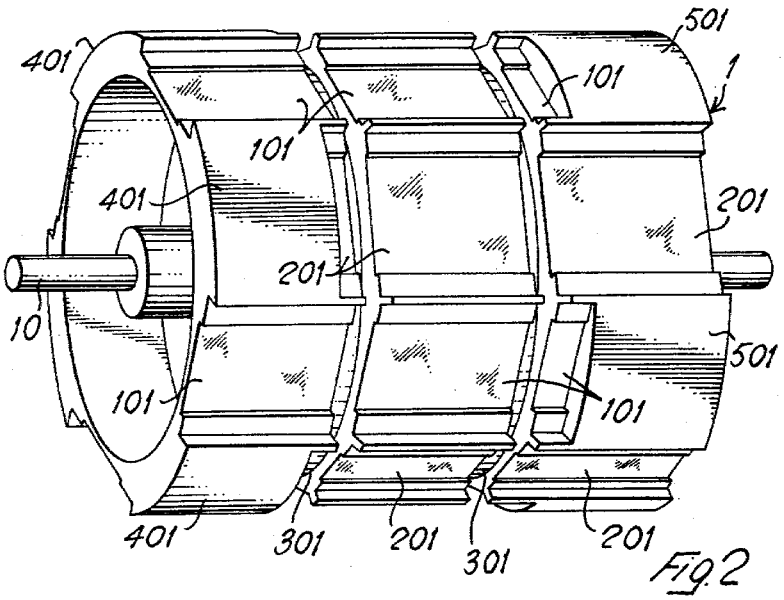
FIG. 2 is a perspective view of the transferring drum forming part of the device according to the invention.

With reference to the drawings, the device according to the invention comprises a cylindrical drum 1 which presents four longitudinal grooves 101 equally interspaced around the periphery of the drum and open in correspondence of the drum head at the left in FIG. 2. The said grooves 101 are intercalated with other four grooves 201, which are open in correspondence of the right head end of the drum itself. The drum 1 presents moreover two interspaced circumferential grooves 301, for the purposes which will be explained later.

The said circumferential grooves 301 subdivide drum 1 longitudinally into three substantially equal parts. The outer parts, to the left and to the right, of drum 1, by virtue of the intercalation of the two sets of grooves 101 and 201 present, respectively, four cylindrical sectors 401, 501, the sectors 401 being angularly offset of 45° with respect to the sectors 501.

Figure 1:
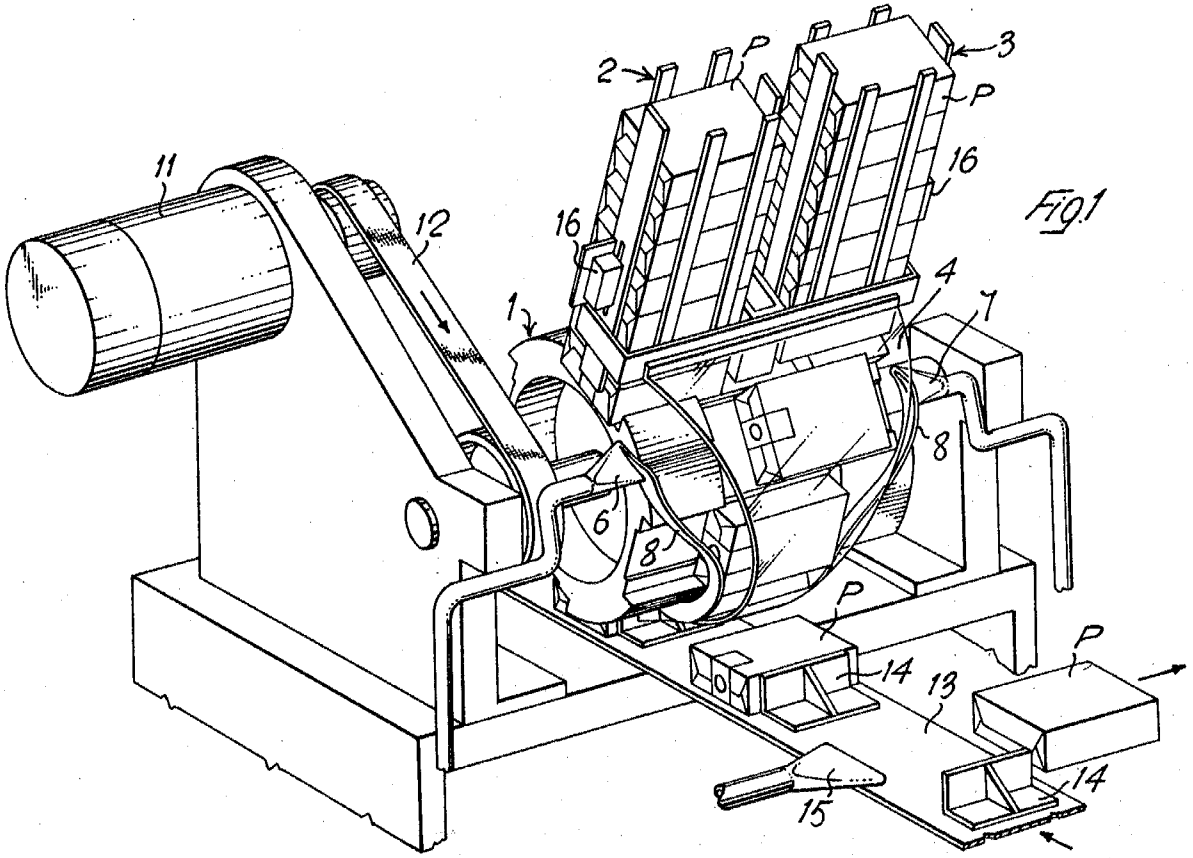
FIG. 1 is a perspective view of the device according to the invention.

With particular reference to FIG. 1, the drum 1 is rotatably mounted in a frame, and above same there are arranged two subvertical hoppers 2, 3 which are located, respectively, in correspondence of the left head end and of the right head end of the drum itself.

Figure 3:
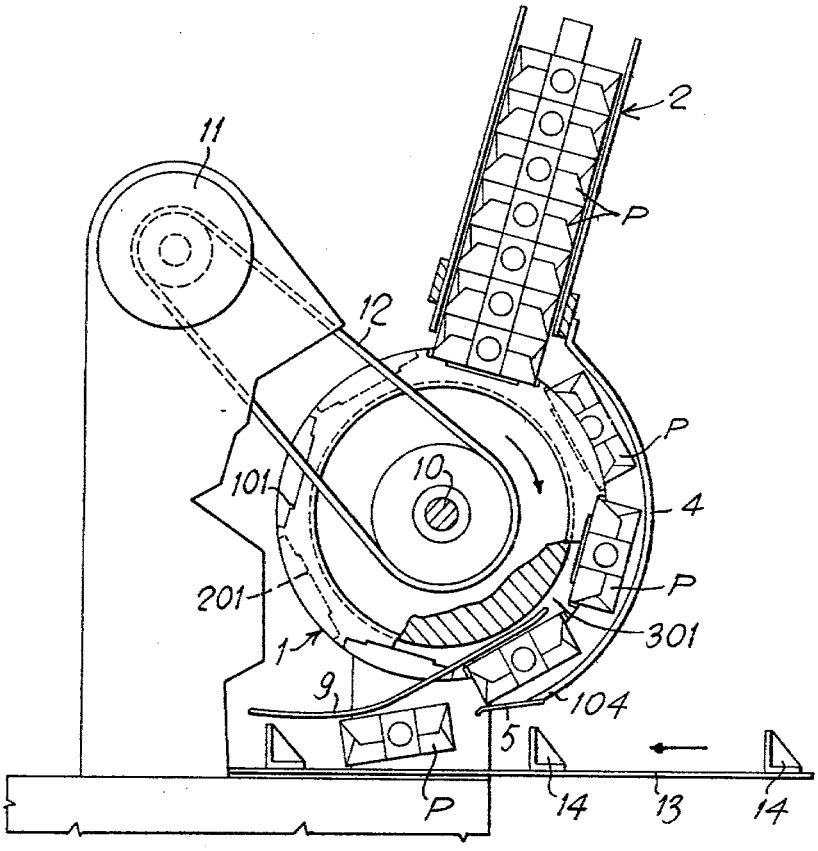
FIG. 3 is a side elevation view, partly sectioned and broken away, of the device according to the invention.

Cooperating with the descending portion of drum 1 (having regard to the direction of rotation indicated for example in FIG. 3) there is arranged the guide 4, which is preferably made of transparent material and is shaped as a portion of a cylindrical surface, concentric to drum 1. The lower end 104 of guide 4 presents the laminar spring 5, as it appears from FIG. 3.

Figure 4:
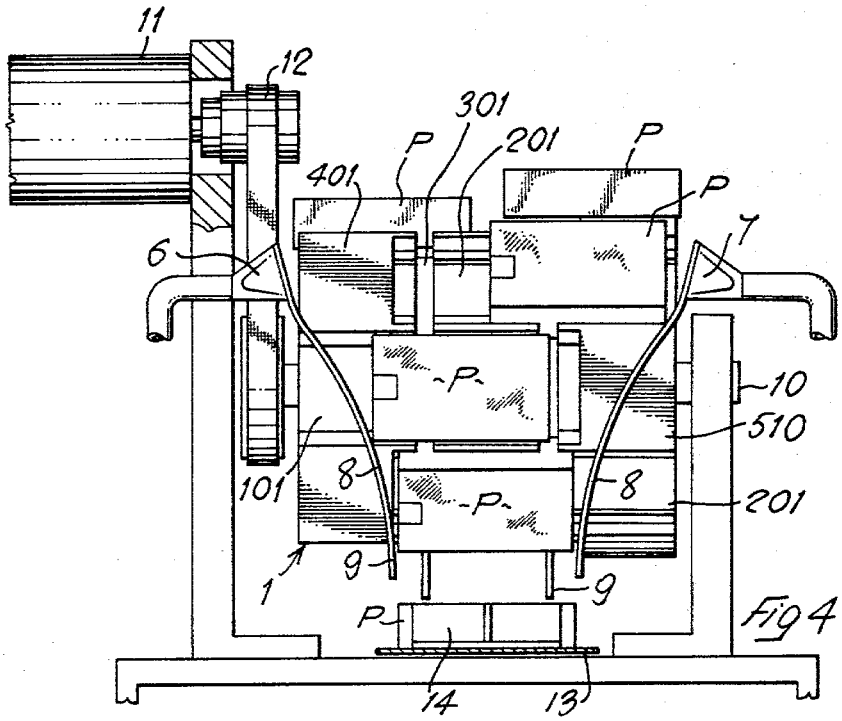
FIG. 4 is a front view of the device according to the invention.

Adjacent to the left and right head ends of the drum 1 there are arranged respectively the blowing heads 6 and 7, which sustain the pair of converging guides 8, which are curved and converging in the direction of rotation of the drum 1. As it can be seen from FIGS. 3 and 4, in the lower section of the circumferential grooves 301 there are arranged the detaching rods 9.

The drum 1 is mounted on shaft 10 and it is rotatably driven by stepping motor 11 by means of the toothed belt 12. Motor 11 is, as above said, of the step type and causes drum 1 to make fractionary rotations of 45°.

The described device is arranged above the feeding conveyer belt 13 which conveys the single packets, and is provided with pushers 14. The median portion of the drum is centered with respect to the said feeding conveyer belt 13.

In the embodiment as described, the belt 13 carries a single row of packets P which has been delivered by a cellophane wrapping machine. Along the path of belt 13 a suitable device (not shown) checks the packets P and the defective packet are discarded sidewise from the feeding line by belt 13, by means of compressed air blows emitted by the blowing head 15, which is operated in response to a control signal emitted by the device which checks the packets.

The operation of the device is as follows. The reserve cigarette packets P are manually loaded into the reserve hoppers 2 and 3. Thanks to the construction of drum 1, the packet P at the base of one hopper stack will be housed in a groove, while the other packet at the base of the other hopper stack will come to bear against one cylindrical sector 501 or 401. In order to preset the device for its operation, the drum 1 must be rotated of three steps of 45°.

As a consequence of the first step rotation, the packet P which is housed in the groove (101 or 201) moves together with drum 1, while the other packet (at the base of the stack of the other reserve hopper) slides on the cylindrical sector (501 or 401) and falls down to be housed in a groove 201 or 101.

In the course of the second and third fractionary rotation of drum 1, the above described operations are repeated, as for what concerns the packets at the base of the stacks in the reserve hoppers 2 and 3, while the bottom packets, extracted from the bases of the hoppers due to the rotation of drum 1, are brought into alignment towards the center, i.e. in the median portion of drum 1, thanks to the combined action of the air jets blown by the blowing heads 6 and 7 and of the guides 8.

A suitable distributing device (not shown) controls the feeding of pressure air alternatively to either one of the blowing heads 6 and 7, in synchronism with the rotary steps of the drum 1.

Upon completion of the third rotational step of drum 1, the lowermost packet which is held between guide 4 and its respective groove in the drum, comes to be at the outlet of the cylindrical channel defined by the said guide 4 and by drum 1, and it is elastically supported and blocked by the laminar spring 5.

Under the above conditions, every time that a defective packet P is discarded sidewise out of belt 13, the motor 11 promotes a one step rotation of 45° of drum 1, so that the packet P supported by laminar spring 5 is deposited onto conveyer belt 13 in the hollow space between two pushers 14, which was previously occupied by the discarded defective packet.

The detaching rods 9 cooperate to the positive deposition of the packet P out of its respective groove onto the conveyer belt.

The reserve hoppers 2 and 3 are each provided with level sensing means 16, which either give a suitable warning signal, or provide to stop the machine upstream of the conveyer belt 13 (in the present case, a cellophane wrapping machine), each time that the stacks of the reserve packets contained in the said reserve hoppers have reached a minimum level.

It is understood that a preferred embodiment of the invention has been described and illustrated, and that many variations and modifications, particularly in the constructive details, are possible, without departing from the inventive principle, as above set out and as hereinafter claimed.

I claim:

1. A device for automatically replacing defective articles discarded from a feeding line on which the articles advance in a single row, comprising:

(a) a pair of gravity-fed reserve hoppers each containing a stack of reserve articles, said reserve hoppers being arranged transversely aligned above said feeding line;

(b) a transferring drum, operatively interposed between said reserve hoppers and said feeding line, said drum being driven in step-by-step rotation in relation to the absence on said feeding line of a discarded defective article, the rotational axis of said transferring drum being arranged transversely with respect to the direction of advancement of said feeding line; said transferring drum presenting a plurality of longitudinal grooves, each of which grooves is intended to receive and house a single article, each groove presenting, alternately intercalated with respect to the adjacent groove, a sector member arranged in correspondence with the discharge end of a reserve hopper, each sector member being adapted to close the discharge end of the respective hopper, whereby upon each step rotation of the transferring drum, an article at the bottom of the stack in one reserve hopper, alternately, is sustained by a sector member and maintained in said one hopper, while the article at the bottom of the other reserve hopper, alternately is permitted to fall into a groove and is progressively transferred to said feeding line and;

(c) guide means for guiding the articles along the groove during the stepwise rotation, in such a manner as to bring the articles into alignment with said feeding line.

2. A device according to claim 1 wherein the defective articles are cigarette packets.

3. A device according to claim 1, in which the sector members are provided intercalated in correspondence of the longitudinal end of each groove, and the reserve hoppers are arranged with their discharge ends in the path of the said sector members.

4. A device according to claim 3, in which the transferring drum is subdivided into three annular zones, the reserve hoppers being arranged in correspondence of the outer annular zones, the feeding line being arranged in correspondence of the central zone, and the guide means being designed so as to promote the convergency of the packets, along the grooves of the transferring drum, from the outer annular zones to the central annular zone.

5. A device according to claim 4, in which circumferential guide means are provided concentrically to the transferring drum, for holding the articles in the grooves during the stepwise rotation of the drum, said circumferential guide means terminating above the feeding line.

6. A device according to claim 5, in which a retaining spring member is provided in correspondence of the termination of the circumferential guide means.

* * * * *